US009541074B2

(12) United States Patent
Glauber

(10) Patent No.: US 9,541,074 B2
(45) **Date of Patent: *Jan. 10, 2017**

(54) AIR-DRIVEN PUMP SYSTEM

(71) Applicant: WILDEN PUMP AND ENGINEERING LLC, Grand Terrace, CA (US)

(72) Inventor: Carl J. Glauber, Jamesville, NY (US)

(73) Assignee: Wilden Pump and Engineering LLC, Grand Terrace, CA (US)

( * ) Notice: Subject to any disclaimer, the term of this patent is extended or adjusted under 35 U.S.C. 154(b) by 278 days.

This patent is subject to a terminal disclaimer.

(21) Appl. No.: 14/479,075

(22) Filed: Sep. 5, 2014

(65) Prior Publication Data

US 2014/0377086 A1 Dec. 25, 2014

Related U.S. Application Data

(63) Continuation of application No. 13/074,258, filed on Mar. 29, 2011, now Pat. No. 9,127,657.

(Continued)

(51) Int. Cl.
*F04B 9/131* (2006.01)
*F04B 9/135* (2006.01)

(Continued)

(52) U.S. Cl.
CPC ..... *F04B 9/131* (2013.01); *F04B 9/133* (2013.01); *F04B 9/135* (2013.01); *F04B 35/00* (2013.01);

(Continued)

(58) Field of Classification Search
CPC ..... F04B 9/131; F04B 9/133; F04B 9/135; F04B 35/00; F04B 43/0736; F04B 2203/10; Y10T 137/8671; Y10T 137/86686; F16K 11/0708
See application file for complete search history.

(56) References Cited

U.S. PATENT DOCUMENTS 2,625,886 A * 1/1953 Browne ..... A01B 69/008 417/390
2,747,612 A * 5/1956 Lee ..... F16K 11/0708 251/282

(Continued)

OTHER PUBLICATIONS

Al Presher, "Intelligent Air Valve", Fluid Power/Power Transmission, Oct. 2009, a Special Editorial Section (3 pgs.).

*Primary Examiner* — Devon Kramer
*Assistant Examiner* — Joseph Herrmann
(74) *Attorney, Agent, or Firm* — Karish & Bjorgum, PC

(57) ABSTRACT

An air-driven pump system comprising: a directional unit that defines a directional air chamber and comprises a directional piston, a first process air intake, and a second process air intake; two pump units each including a liquid chamber, an air chamber, and a piston; a shaft affixed to the pistons; an efficiency valve system comprising an efficiency piston, wherein the efficiency unit is configured to divide inlet air entering the air-driven piston pump into control air, first process air, and second process air, and wherein the efficiency piston is in communication with the control air, first process air, and second process air before the air is distributed to the directional unit; and a second shaft which is in communication with the efficiency piston. The efficiency valve system is to prevent overfilling of the air chambers.

19 Claims, 14 Drawing Sheets

Related U.S. Application Data

(60) Provisional application No. 61/341,160, filed on Mar. 29, 2010.

(51) Int. Cl.
*F04B 9/133* (2006.01)
*F04B 43/073* (2006.01)
*F04B 35/00* (2006.01)

(52) U.S. Cl.
CPC ..... *F04B 43/0736* (2013.01); *F04B 2203/10* (2013.01)

(56) References Cited

U.S. PATENT DOCUMENTS 3,630,642 A 12/1971 Osterman
3,782,863 A 1/1974 Rupp
3,838,946 A * 10/1974 Schall ..... F01L 15/08 417/393
3,849,033 A * 11/1974 Schall ..... F01L 15/08 417/454
4,155,535 A * 5/1979 Seamone ..... F16K 11/0708 137/625.3
4,381,180 A * 4/1983 Sell ..... F04B 43/0736 137/625.27
4,386,888 A * 6/1983 Verley ..... B67D 1/103 417/393
4,406,596 A * 9/1983 Budde ..... F04B 43/0736 417/393
4,472,115 A 9/1984 Rupp
4,494,912 A 1/1985 Pauliukonis
4,496,294 A 1/1985 Frikker
4,674,958 A 6/1987 Igarashi et al.
4,830,586 A 5/1989 Herter et al.
4,854,832 A 8/1989 Gardner et al.
5,169,296 A 12/1992 Wilden
5,174,731 A * 12/1992 Korver ..... F16K 11/0704 417/393
5,257,914 A 11/1993 Reynolds
5,332,372 A 7/1994 Reynolds
5,368,452 A 11/1994 Johnson et al.
5,927,954 A 7/1999 Kennedy et al.
5,944,042 A * 8/1999 Takahashi ..... F16K 11/07 137/1
6,644,941 B1 11/2003 Able et al.
7,399,168 B1 7/2008 Eberwein
7,517,199 B2 4/2009 Reed et al.
7,527,483 B1 5/2009 Glauber
7,658,598 B2 2/2010 Reed et al.
8,292,600 B2 10/2012 Reed et al.
8,485,792 B2 7/2013 McCourt et al.
8,608,460 B2 12/2013 McCourt et al.
2006/0104829 A1 5/2006 Reed et al.

* cited by examiner

AIR-DRIVEN PUMP SYSTEM

CROSS-REFERENCE TO RELATED APPLICATIONS

The present application claims priority to U.S. Provisional Patent Application No. 61/341,160, filed on Mar. 29, 2010, and entitled "Air-Driven Fluid Pump System," and is a continuation of U.S. patent application Ser. No. 13/074,258, filed Mar. 29, 2011, now U.S. Pat. No. 9,127,657, issued Sep. 8, 2015, the content of each being relied upon and incorporated herein by reference in their entirety.

BACKGROUND OF THE INVENTION

1. Field of the Invention

The present invention relates to a pneumatically-driven equipment, and, more specifically, to an efficiency valve in that equipment.

2. Description of the Related Art

Pneumatically driven equipment typically relies on mechanically moving parts to operate. The equipment will typically split the inlet motive air into process air and control air, in which the process air is used to perform the work and the control air is used to control the direction or motion of the mechanical components.

However, there is an inherent inefficiency that occurs in such air-driven equipment. The inefficiency is related to the reaction time or response time of the mechanical components as compared to the flow rate of both the process air and control air. In other words, the flow rate of the motive air far exceeds the velocity of the mechanical components because of friction losses and other dynamic losses acting on the mechanical components, created by the movement of the mechanical components. The inefficiency occurs when motive air is wasted by allowing it to continuously flow unrestricted into the pneumatic equipment when the process air has completed a first segment of work and the control air is mechanically moving components to a position that allows the process air to perform a second segment of work.

An example of this inefficiency is illustrated in FIGS. 1-3, which depict a schematic representation of an air-operated piston pump having a general design. In FIG. 1, inlet motive air is split into process air and control air. Control air positions the directional valve piston 11 inside directional valve 10 by filling chambers 12. Control air is also channeled out of chamber 12 and directional valve 10 and into pilot valve 40, and is then directed through pilot valve piston 41 to be channeled back to directional valve 10 through pilot passage 13, thereby pressurizing chamber 13 in directional valve 10. Although the control pressure is equal for both chambers 12 and 13, the surface area of piston 11 on which the control pressure is acting is greater in chamber 13, causing piston 11 to move and remain to the "left" in directional valve 10. This allows the process air to pass through directional valve 10 and directional valve piston 11 and then be channeled to pump unit 30, thereby expanding into air chamber 32, acting on piston 31, and moving piston 31 to discharge liquid from liquid chamber 33. At the same time, movement of piston 31 toward the right pulls shaft 54, thereby moving piston 21 inside pump unit 20. Movement of piston 21 toward the other pump unit causes liquid to be drawn into liquid chamber 23 as once-used process air is released from air chamber 22 out of pump unit 20 and channeled through directional valve 10 and directional valve piston 11 to atmosphere.

In FIG. 2, piston 21 engages and moves shaft 64, which is connected to pilot valve piston 41 inside of pilot valve 40. Movement of piston 21 moves shaft 64 and pilot valve piston 41 to a position that allows channeled control air to be released to atmosphere from chamber 13 inside directional valve 10. Control air pressure in chamber 12 acts on directional valve piston 11, moving directional valve piston 11 toward the right inside directional valve 10.

In FIG. 3, directional valve piston 11 in directional valve 10 is held stationary by the control air pressure in chamber 12 acting on directional valve piston 11, thereby allowing process air to be channeled through directional valve 10 and directional valve piston 11 to pump unit 20, where it expands into air chamber 22 as once used process air is released from air chamber 32 in pump unit 30. The process air is further channeled through directional valve 10 and directional valve piston 11 to atmosphere, making pistons 21 and 31 and shaft 54 reverse their previous directions, thereby causing piston 21 to force liquid from liquid chamber 23 to discharge as piston 31 draws liquid into liquid chamber 33.

The inefficiency with the above-described design occurs during the transition from FIG. 2 to FIG. 3. During the total time period that it takes moving pilot valve piston 41 in pilot valve 40 to move to a position that re-directs control air to or from directional valve 10 and directional valve piston 11 moves completely to its new position to allow process air to perform a new segment of work (from "left" in FIG. 2 to "right" in FIG. 3), process air is allowed to continue entering the air chamber (air chamber 32 in FIG. 2) unrestricted, which overfills or over pressurizes the air chamber without additional liquid being discharged from it corresponding liquid chamber (liquid chamber 33 in FIG. 2). This overfilling or over pressurizing of the air chamber is a waste of energy.

There is, therefore, a continued need for pneumatically driven equipment such as air-driven liquid pumps that are more efficient and utilize less energy than previous designs.

BRIEF SUMMARY OF THE INVENTION

It is therefore a principal object and advantage of the present invention to provide a more efficient pneumatically driven pump.

It is another object and advantage of the present invention to provide a pneumatically driven pump that utilizes less air for pumping.

It is yet another object and advantage of the present invention to provide a pneumatically driven pump that utilizes less energy.

Other objects and advantages of the present invention will in part be obvious, and in part appear hereinafter.

In accordance with the foregoing objects and advantages, the present invention provides an air-driven piston pump comprising: (i) a directional unit that defines a directional air chamber and comprises a directional piston, a first process air intake, and a second process air intake; (ii) a first pump unit comprising a first liquid chamber, a first air chamber, and a first piston, where the first piston is located inside the first pump unit between the first liquid chamber and the first air chamber, and the first piston moves between a first position and a second position; (iii) a second pump unit comprising a second liquid chamber, a second air chamber, and a second piston, where the second piston is located inside the second pump unit between the second liquid chamber and the second air chamber, and the second piston is moveable between a first position and a second position; (iv) a first shaft affixed at one first end to the first piston and affixed at the other end to the second piston; (v) an efficiency unit comprising an efficiency piston, wherein the efficiency unit is configured to divide inlet air entering the air-driven piston pump into control air, first process air, and second process air, and wherein the efficiency piston is in communication with the control air, first process air, and second process air before the air is distributed to the directional unit; (vi) a second shaft which is in communication with the efficiency piston. In a preferred embodiment, the efficiency piston is moveable between a first position and a second position, where the first position allows control air to communicate with the directional unit air chamber, allows first process air to distribute to the first process air intake of the directional unit, and restricts second process air, thereby allowing restricted second process air to distribute to the second process air intake of the directional unit. In the second position, the efficiency piston allows control air to communicate with the directional valve air chamber, allows second process air to distribute to the second process air intake of the directional unit, and restricts first process air, thereby allowing restricted first process air to distribute to the first process air intake. The efficiency piston is preferably affixed to the second shaft at some location along the length of the second shaft.

According to a second aspect of the present invention, the second shaft comprises a first end and a second end. The first end is located at least partially within the first pump unit and is positioned to communicate with the first piston when the first piston is in the second position. The second end is located at least partially within the second pump unit and is positioned to communicate with the second piston when the second piston is in the second position. In a preferred embodiment, when the first end of the second shaft is in communication with the first piston, the efficiency piston moves to the second position, and when the second end of the second shaft is in communication with the second piston, the efficiency piston moves to the first position.

According to a third aspect of the present invention is provided an air-driven piston pump comprising: (i) a directional unit which defines a directional air chamber and comprises a directional piston, a first process air intake, and a second process air intake; (ii) a first pump unit comprising a first liquid chamber, a first air chamber, and a first piston, the first piston located inside the first pump unit between the first liquid chamber and the first air chamber and moveable between a first position and a second position; (iii) a second pump unit, the second pump unit comprising a second liquid chamber, a second air chamber, and a second piston, the second piston located inside the second pump unit between the second liquid chamber and the second air chamber and moveable between a first position and a second position; (iv) a first shaft affixed at a first end to the first piston and affixed at a second end to the second piston; (v) a first efficiency unit comprising a first process air inlet, a first process air outlet, and a first efficiency piston comprising a first efficiency piston shaft, where the first efficiency piston is moveable between a first position and a second position; (vi) a second efficiency unit comprising a second process air inlet, a second process air outlet, and a second efficiency piston comprising a second efficiency piston shaft, where the second efficiency piston is moveable between a first position and a second position; (vii) a pilot unit comprising a pilot piston, where the pilot piston is moveable to at least a first position and a second position; and (viii) a second shaft which is in communication with the pilot piston.

According to a fourth aspect of the present invention, the second shaft of the above-described pump comprises a first end and a second end. The first end is located at least partially within the first pump unit and is positioned to communicate with the first piston when the first piston is in the second position. The second end of the second shaft is located at least partially within the second pump unit and is positioned to communicate with the second piston when the second piston is in the second position. In a preferred embodiment, when the first end of the second shaft is in communication with the first piston, the pilot piston moves to the second position, and when the second end of the second shaft is in communication with the second piston, the pilot piston moves to the first position.

According to a fifth aspect of the present invention, at least a portion of the first efficiency piston shaft is located within the first pump unit and is positioned to communicate with the first piston when the first piston is in the second position. At least a portion of the second efficiency piston shaft is located within the second pump unit and is positioned to communicate with the second piston when the second piston is in the second position. Further, when the first efficiency piston shaft communicates with the first piston, the first efficiency piston moves to the second position and restricts the distribution of air through the first efficiency unit to the first process air intake of the directional unit. When the second efficiency piston shaft communicates with the second piston, the second efficiency piston moves to the second position and restricts the distribution of air through the second efficiency unit to the second process air intake of the directional unit. When the first efficiency piston shaft is no longer in communication with the first piston, the first efficiency piston moves to the first position and allows, or un-restricts, the full distribution of first process air through the first efficiency unit to the first process air intake of the directional unit. When the second efficiency piston shaft is no longer in communication with the second piston, the second efficiency piston moves to the first position and allows, or un-restricts, the full distribution of second process air through the second efficiency unit to the second process air intake of the directional unit.

According to a sixth aspect of the present invention is provided an air-driven piston pump comprising: (i) a directional unit defining a directional air chamber and comprising a directional piston, a first process air intake, and a second process air intake, the directional piston moveable between a first position and a second position; (ii) a first stage pump unit, the first stage pump unit defining a first stage air chamber; (iii) a first pump unit, the first pump unit comprising a first liquid chamber, a first second stage air chamber, and a first piston, where the first piston is located inside the first pump unit between the first liquid chamber and the first second stage air chamber and is moveable between a first position and a second position; (iv) a second pump unit, the second pump unit comprising a second liquid chamber, a second second stage air chamber, and a second piston, where the second piston is located inside the second pump unit between the second liquid chamber and the second second stage air chamber and is moveable between a first position and a second position; (v) a first shaft affixed at a first end to the first piston and affixed at a second end to the second piston; (vi) a first stage piston located inside the first stage air chamber and affixed to the first shaft, wherein the first stage piston and the first shaft are moveable from a first position to a second position; (vii) a first efficiency unit comprising a first control air port, a first air inlet, a first process air outlet, and a first efficiency piston comprising a control air channel and a first efficiency piston shaft, where the first efficiency piston is moveable between a first position and a second position; and (viii) a second efficiency unit comprising a control air port, a second air inlet, a second process air outlet, and a second efficiency piston comprising a control air channel and a second efficiency piston shaft, where the second piston is moveable between a first position and a second position.

According to a seventh aspect of the present invention, at least a portion of the first efficiency piston shaft is located within the first pump unit and is positioned to communicate with the first piston when the first piston is in the second position. Similarly, at least a portion of the second efficiency piston shaft is located within the second pump unit and is positioned to communicate with the second piston when the second piston is in the second position. In a preferred embodiment, when the first efficiency piston shaft communicates with the first piston, the first efficiency piston moves to the second position and restricts the distribution of first process air through the first efficiency unit to the first process air intake of the directional unit, and allows control air to communicate between the directional air chamber and first air chamber. Similarly, when the second efficiency piston shaft communicates with the second piston, the second efficiency piston moves to the second position and restricts the flow of second process air through the second efficiency unit to the second process air intake of the directional unit, and allows control air to communicate between the directional air chamber and the second air chamber. When the first efficiency piston shaft is no longer in communication with the first piston, the first efficiency piston moves to the first position and allows, or un-restricts, the full distribution of first process air through the first efficiency unit to the first process air intake of the directional unit and allows control air to communicate with the directional air chamber. When the second efficiency piston shaft is no longer in communication with the second piston, the second efficiency piston moves to the first position and allows, or un-restricts, the full distribution of second process air through the second efficiency unit to the second process air intake of the directional unit and allows control air to communicate with the directional air chamber.

BRIEF DESCRIPTION OF THE SEVERAL VIEWS OF THE DRAWINGS

The present invention will be more fully understood and appreciated by reading the following Detailed Description in conjunction with the accompanying schematic drawings, in which.

DETAILED DESCRIPTION OF THE PREFERRED EMBODIMENTS

Figure 1:
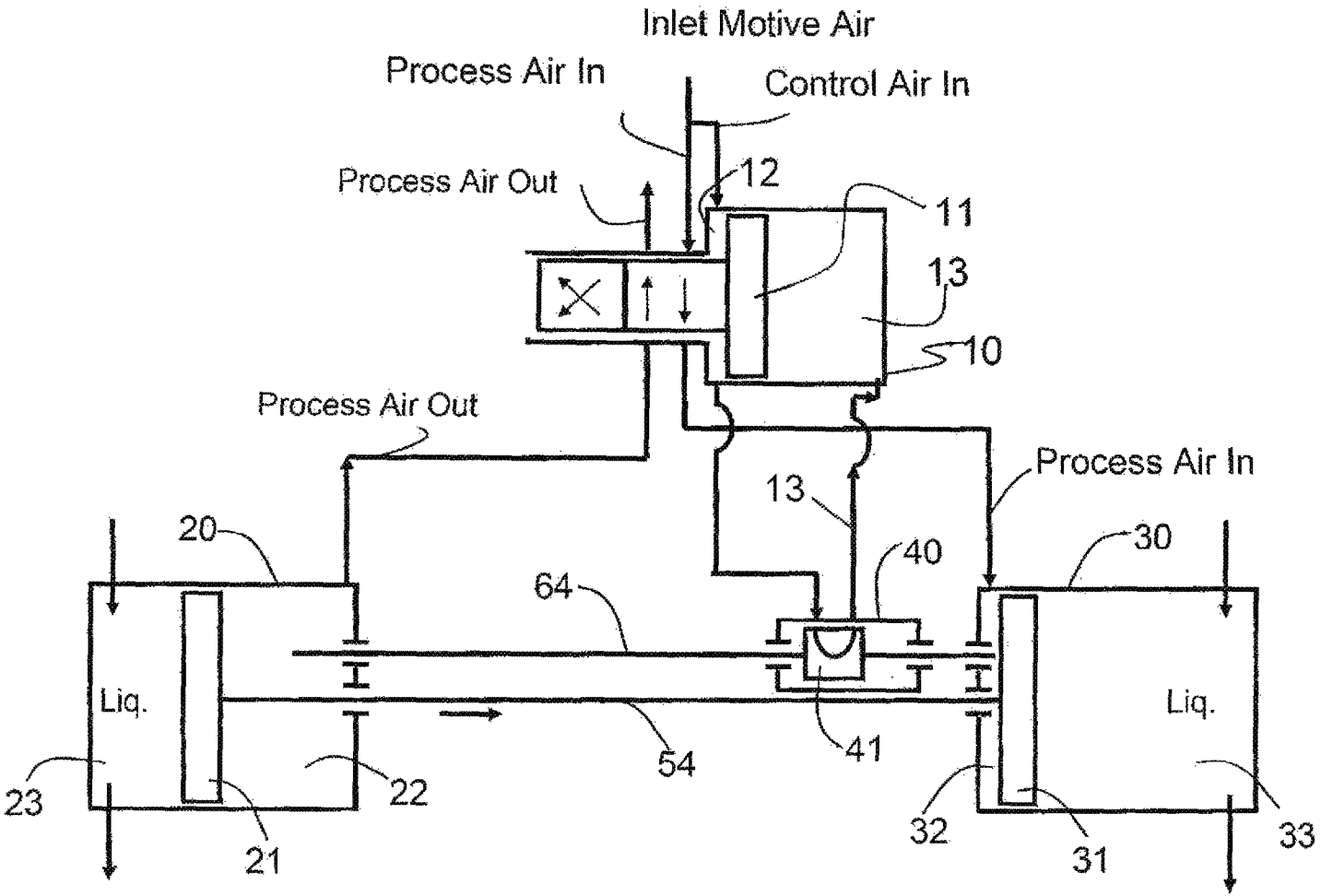
FIG. 1 Prior Art
FIGS. 1-3 represent an air-driven expansible chamber pump system of the prior art.
Figure 2:
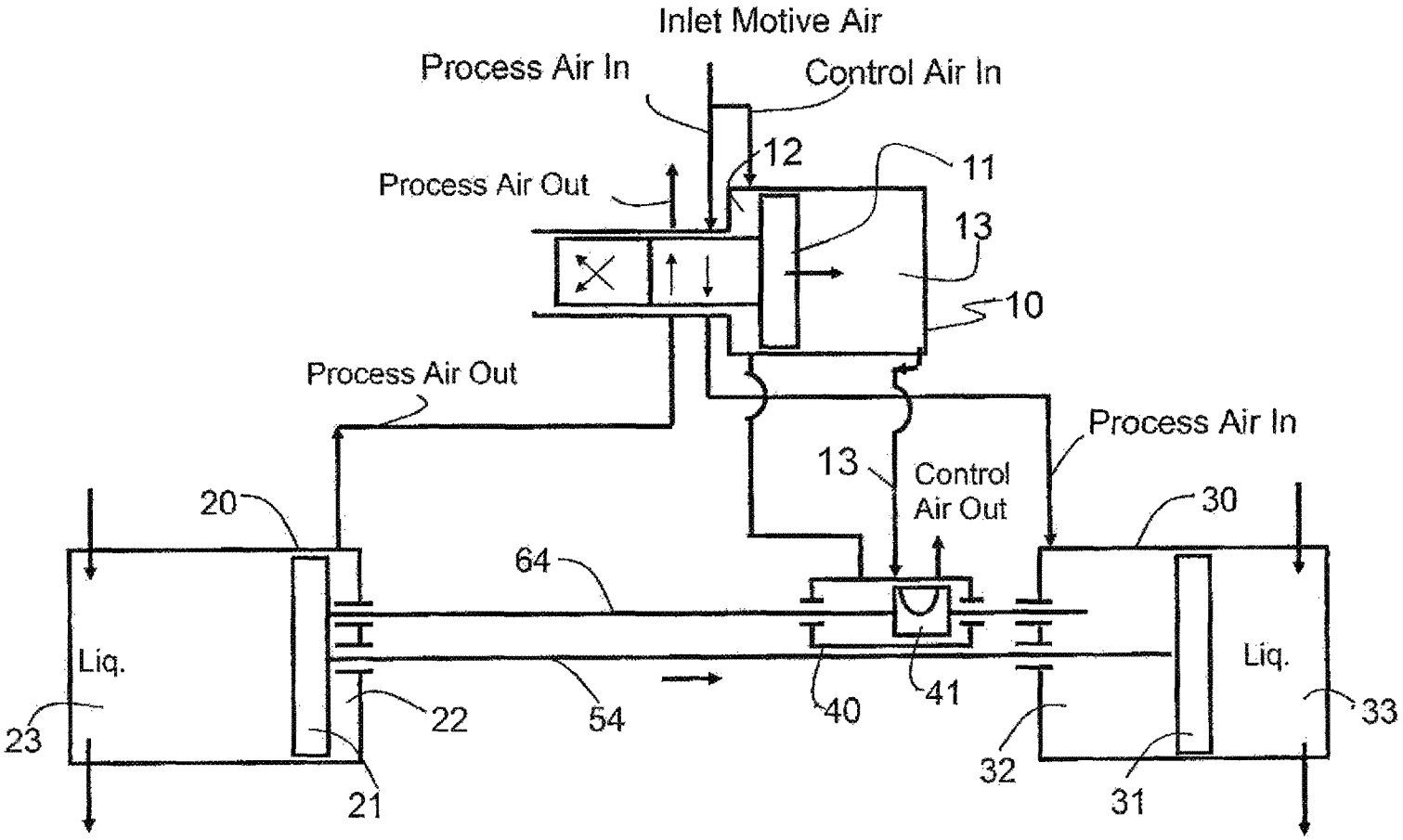
FIG. 2 Prior Art
Figure 3:
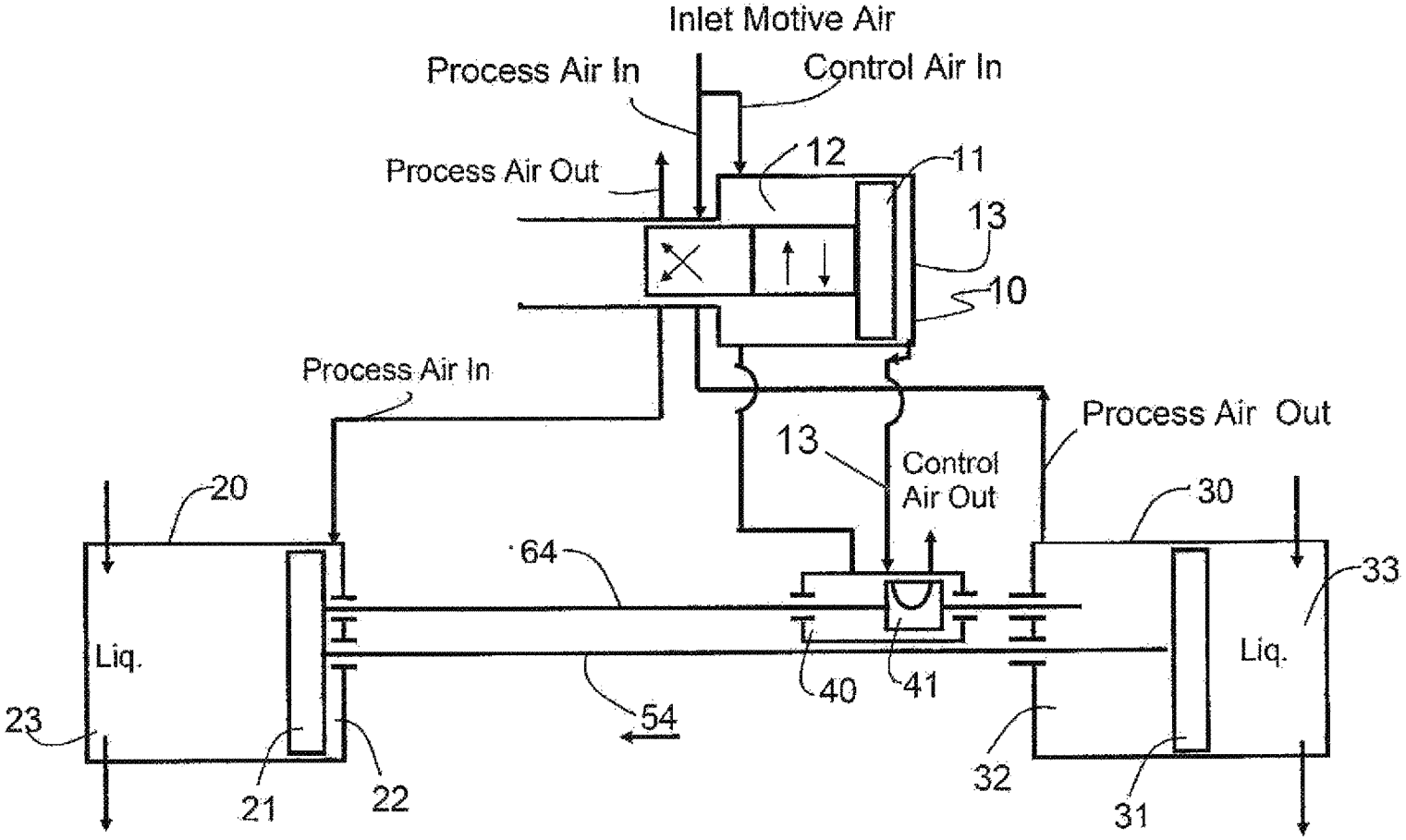
FIG. 3 Prior Art

Referring now to the drawings, wherein like reference numerals refer to like parts throughout, there is seen in FIGS. 4-13 several air-driven pump systems according to embodiments of the present invention. Each air-driven pump system comprises an efficiency valve that allows pneumatic equipment to significantly reduce the energy waste associated with overfilling or over pressurizing during operation, as compared to prior art designs.

The pump systems described herein have a multitude of different uses and utilities. For example, the pump systems described herein and claimed below can be used to pump a wide variety of liquids. In addition to liquids, the pump systems can pump any gas capable of being pumped, including air. Any reference to a "liquid" pump system should be construed to mean a pump system capable of pumping a liquid and/or a gas.

It should be noted that while the Examples described herein refer to several different elements as a "piston," these elements could also be a diaphragm component in other embodiments of the present invention. A diaphragm component would typically comprise a central diaphragm with a piston element located on either or both sides which perform(s) the functions of the pistons described in the Examples below. Further, it should be noted that in a preferred embodiment, each of the pistons described herein comprise a perimeter seal such as an o-ring or a sleeve to prevent leakage, although any mechanism of preventing leaking known in the art could be used. Pressure transmitting devices such as pistons and diaphragms being generically identified herein as dividers.

Example 1

Figure 4:
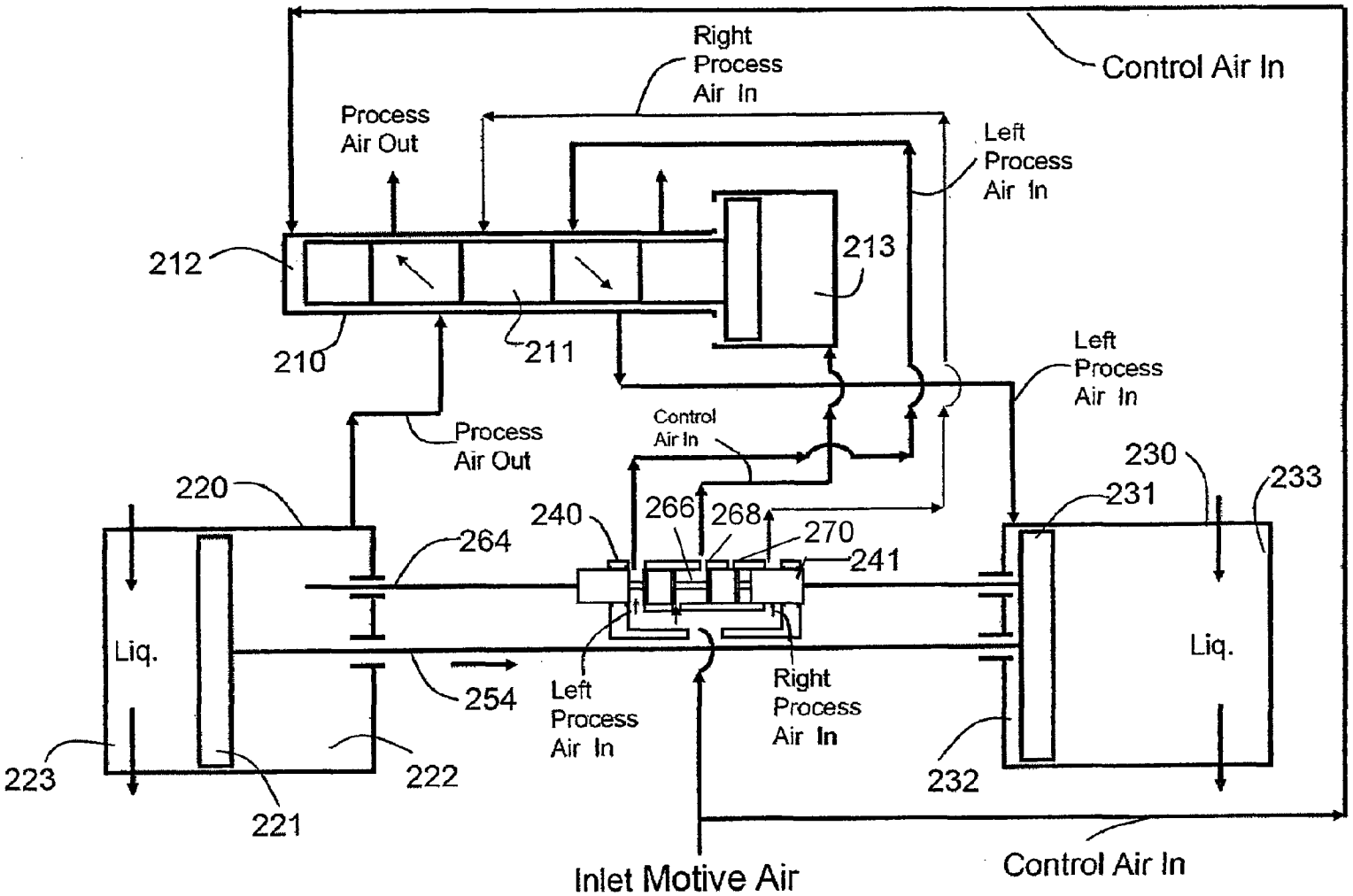
FIGS. 4, 4A, 5-6 represent an air-driven expansible chamber pump system of this invention with FIG. 4A representing a detail of the efficiency valve thereof.
Figure 4A:
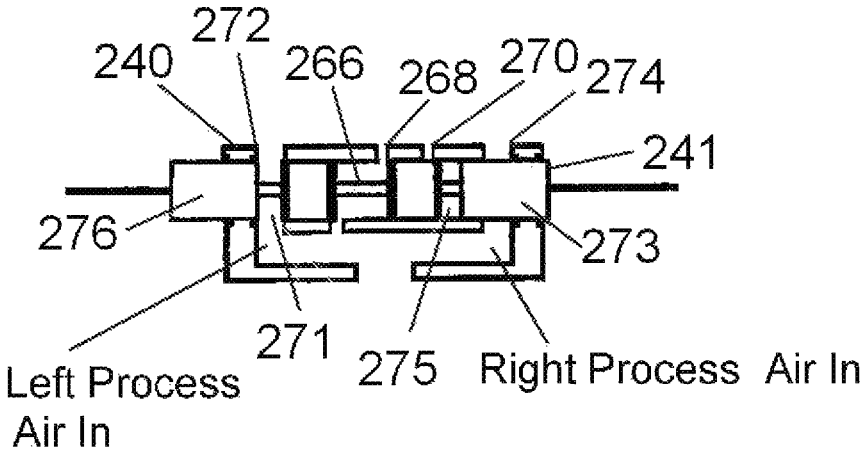
Figure 8A:
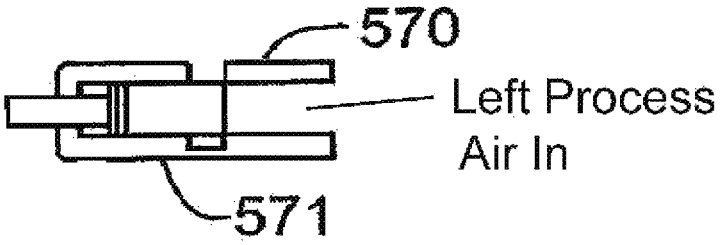
FIGS. 7-8, 8A-9 represent an air-driven expansible chamber pump system of this invention with FIG. 8A representing a detail of the left efficiency valve thereof.
Figure 10A:
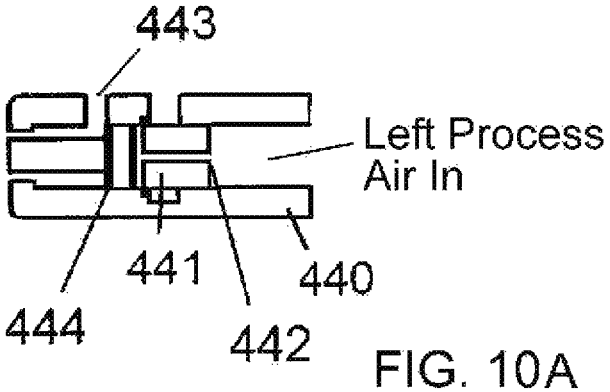
FIGS. 10, 10A-13 represent an air-driven expansible chamber pump system of this invention with FIG. 10A representing a detail of the left efficiency valve thereof.
Figure 5:
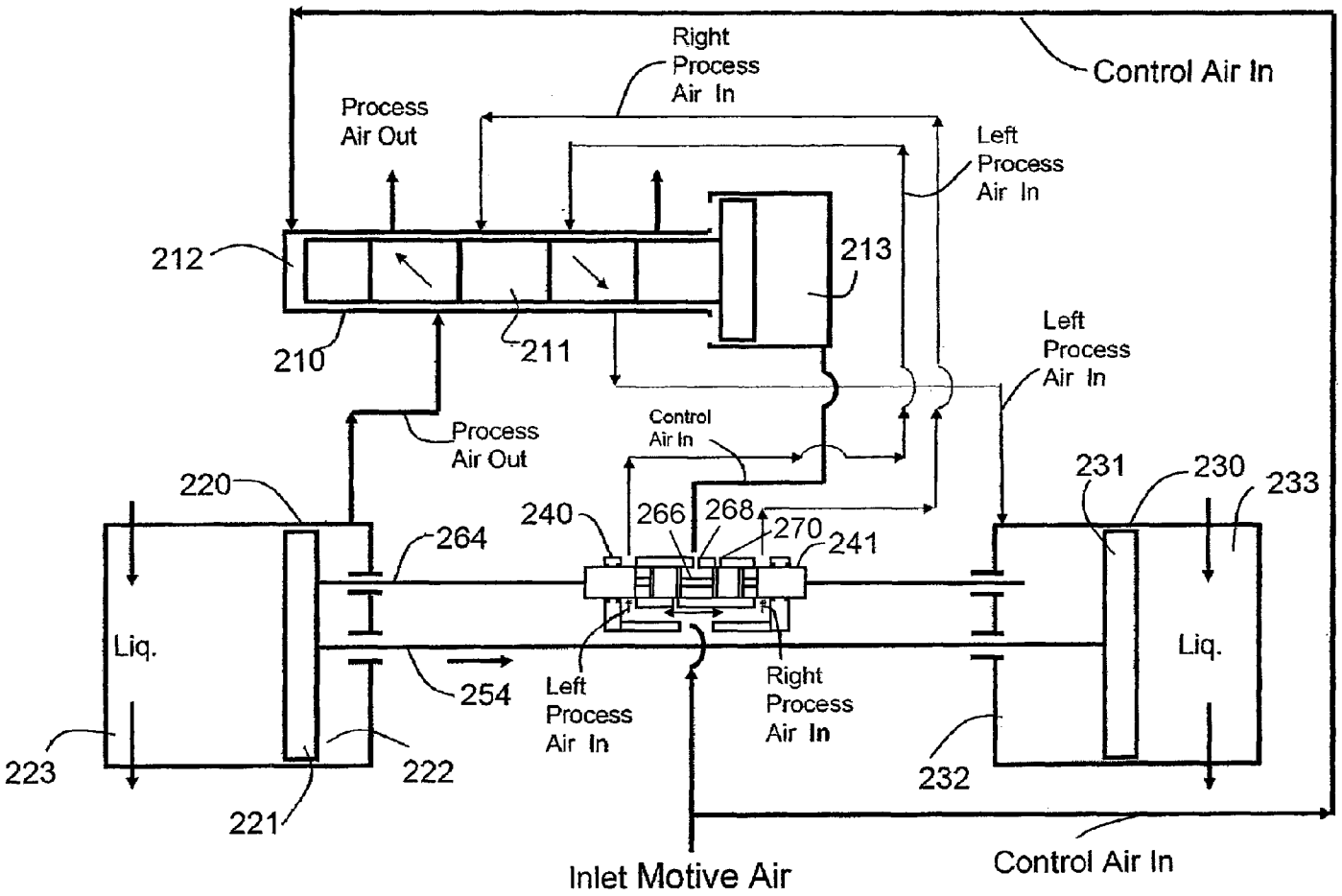
Figure 6:
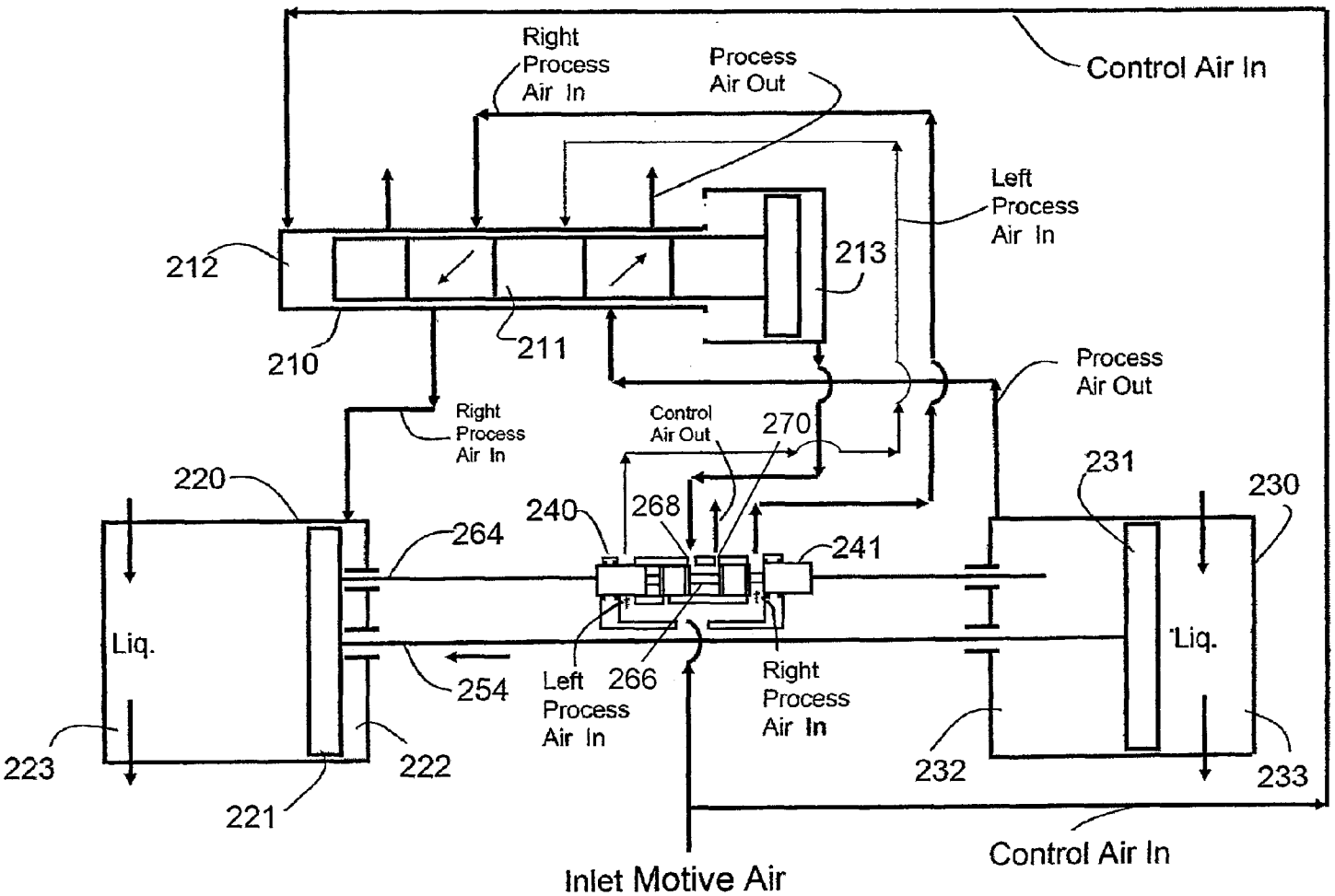

The air-driven pump system described in Example 1 is shown in FIGS. 4-6. Starting with FIG. 4, inlet motive air enters the pneumatic pump. A small portion of the motive air is used as control air and is channeled to directional valve 210, thereby pressurizing chamber 212 to act on the small surface area of directional valve piston 211 inside directional valve 210. The balance of the inlet motive air enters efficiency valve 240 and is segmented into control air, left process air and right process air. Control air passes through efficiency valve piston 241 and exits efficiency valve 240 through pilot valve port 268 and is channeled through the pilot passage to pressurize chamber 213 in directional valve 210 acting on the large surface area of directional valve piston 211 inside directional valve 210, moving and holding directional valve piston 211 to the left inside directional valve 210. (Refer to the reference numbers in FIG. 4A). Left process air passes through efficiency valve groove 271 in efficiency valve piston 241 inside efficiency valve 240, unrestricted in its flow rate from efficiency valve port 272. Right process air passes around efficiency valve piston land 273 of efficiency valve piston 241 inside efficiency valve 240, maximally restricted in its flow rate from efficiency valve port 274. Both left and right process air are channeled to directional valve 210 from efficiency valve ports 272, 274. Directional valve piston 211 inside directional valve 210 blocks maximally restricted right process air and allows unrestricted left process air to pass through and exit directional valve 210 and be channeled to pump unit 230 where it expands and pressurizes air chamber 232 causing piston 231 to displace liquid from liquid chamber 233. At the same time, shaft 254 being connected to pistons 231 and 221 moves piston 221, inside pump unit 220, drawing liquid into liquid chamber 223 as once used process air is released from air chamber 222 out of pump unit 220 and channeled through directional valve 210 and directional valve piston 211 to atmosphere.

In FIG. 5, toward the end of its stroke, piston 221 in pump unit 220 engages and moves shaft 264 which is connected to efficiency valve piston 241 inside of efficiency valve 240. The movement of efficiency valve piston 241 un-restricts the exiting right process air out of efficiency valve 240 through efficiency valve groove 275 and from efficiency valve port 274, and maximally restricts the left process air flow rate around efficiency valve piston land 276 out of efficiency valve port 272 of efficiency valve 240.

In FIG. 6, efficiency valve piston 241 is moved to a position that allows channeled control air to be released to atmosphere from chamber 213 inside of directional valve 210. Control air pressure in chamber 212 of directional valve 210, acts on and moves directional valve piston 211 to the "right" inside of directional valve 210. During the movement of directional valve piston 211, maximally restricted left process air continues to flow at its maximally restricted flow rate through efficiency valve groove 271, by efficiency valve piston land 276, through efficiency valve port 272 and through directional valve 210 and directional valve piston 211 channeled to air chamber 232 of pump unit 230, reducing over filling or over pressurizing of air chamber 232. Directional valve piston 211 is held stationary to the right inside directional valve 210 by the control air pressure in chamber 212. As such, the pilot valve groove 266 in the efficiency valve piston 241 and the pilot valve ports 268, 270 through the cylinder of the efficiency valve 240 to the directional valve chamber 213 and to control air out, respectively, define the pilot valve system in this embodiment. Maximally restricted left process air exiting efficiency valve 240 is channeled to directional valve 210 and blocked by directional valve piston 211. Unrestricted right process air through efficiency valve groove 275 and from efficiency valve port 274 exiting efficiency valve 240 is channeled through directional valve 210 and directional valve piston 211 to pump unit 220, expanding into air chamber 222 as once used process air is channeled to atmosphere from air chamber 232 out of pump unit 230 and through directional valve 210 and directional valve piston 211. Pistons 221, 231 and shaft 254 reverse their directions. Unrestricted right process air acts on piston 221 in pump unit 220 to discharge liquid from liquid chamber 223 as piston 231 in pump unit 230 draws liquid into liquid chamber 233.

Example 2

Figure 7:
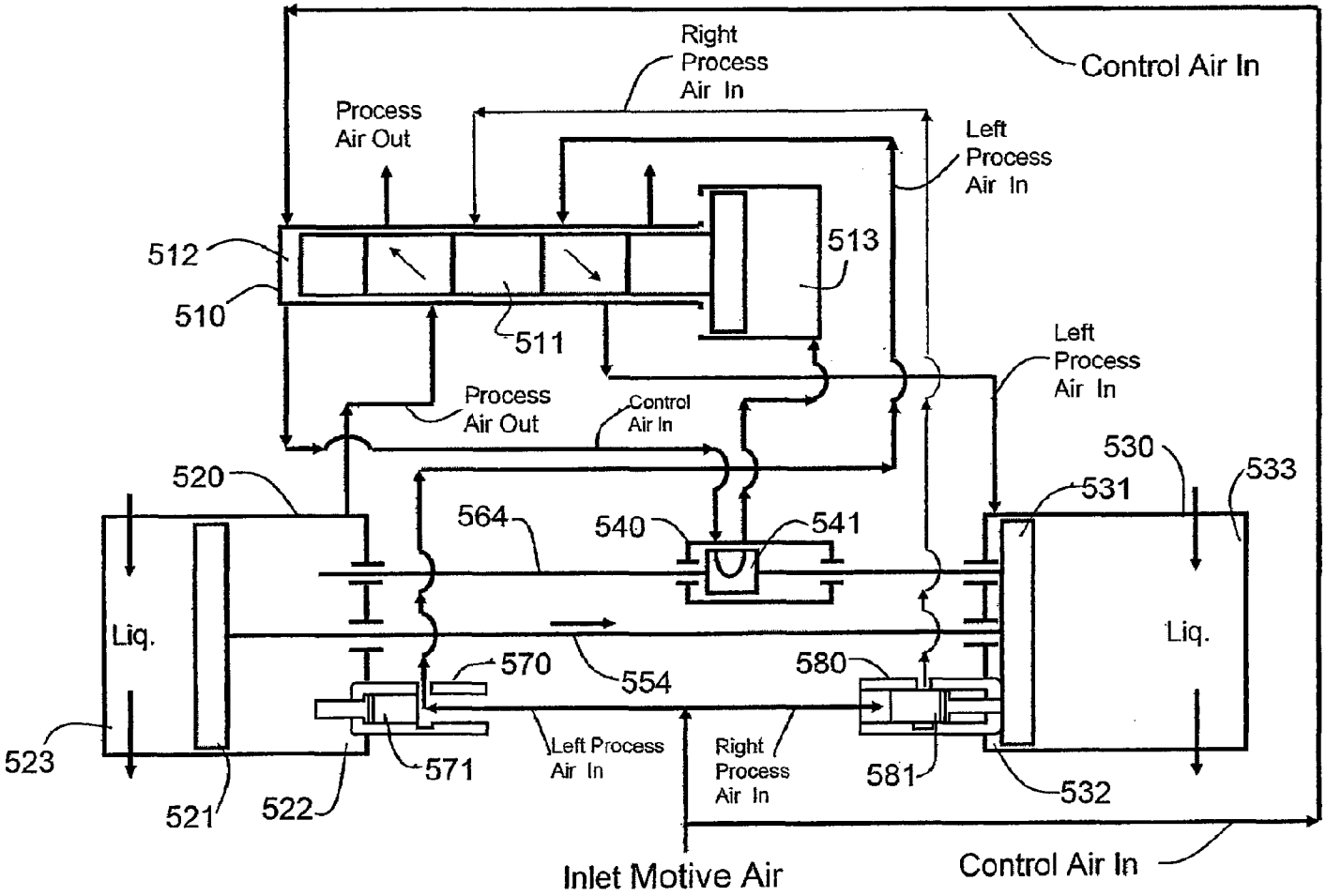
Figure 8:
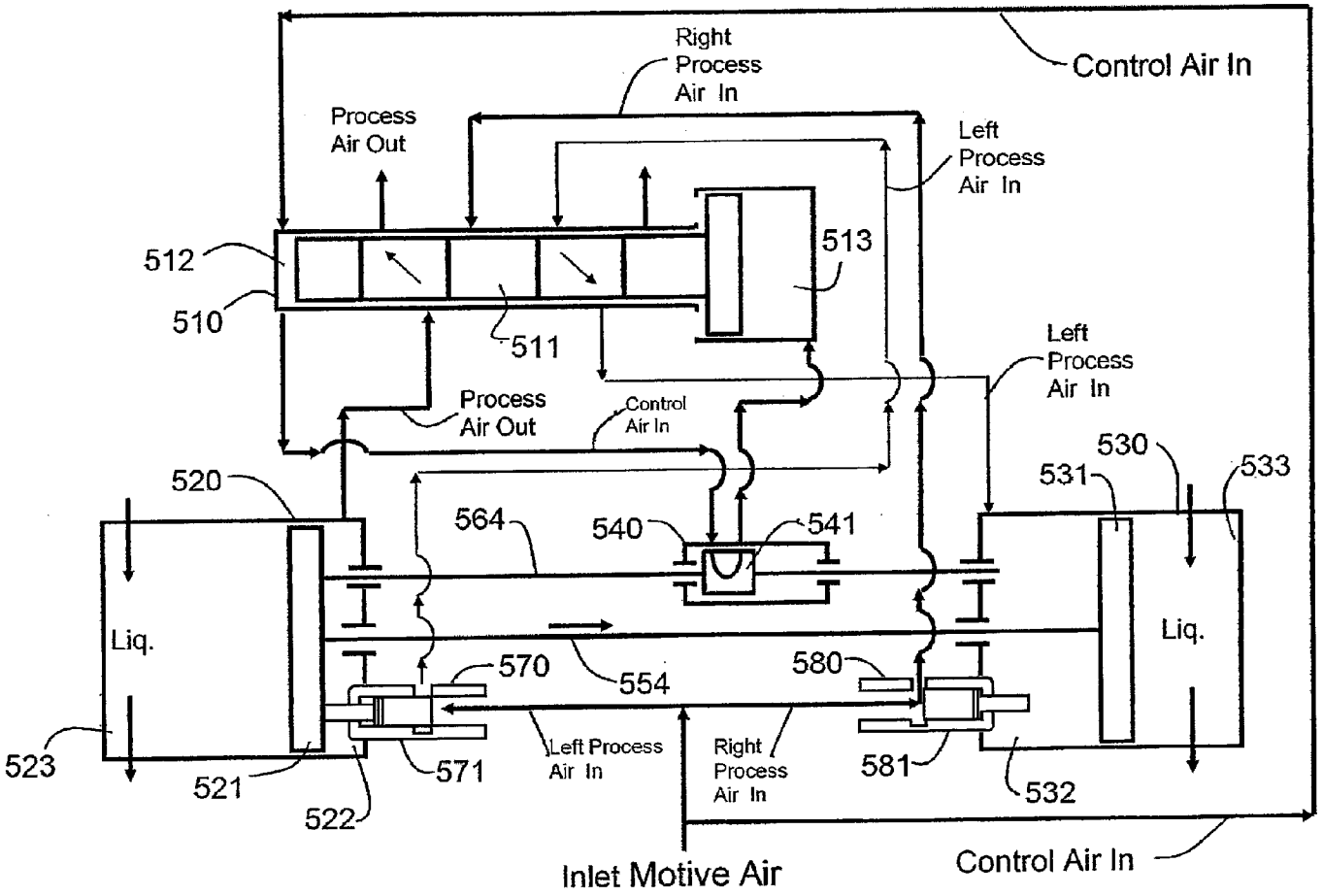
Figure 9:
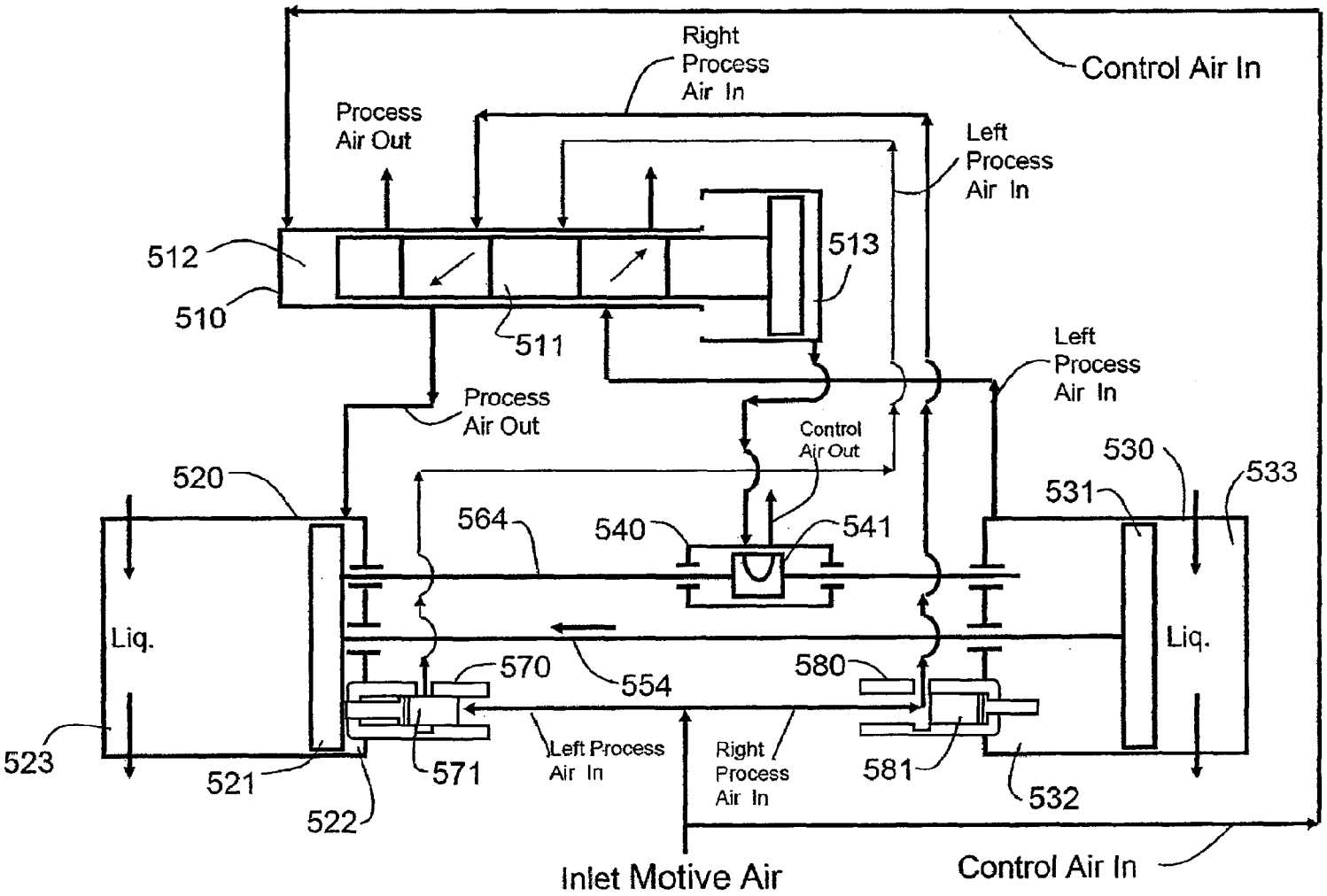
Figure 10:
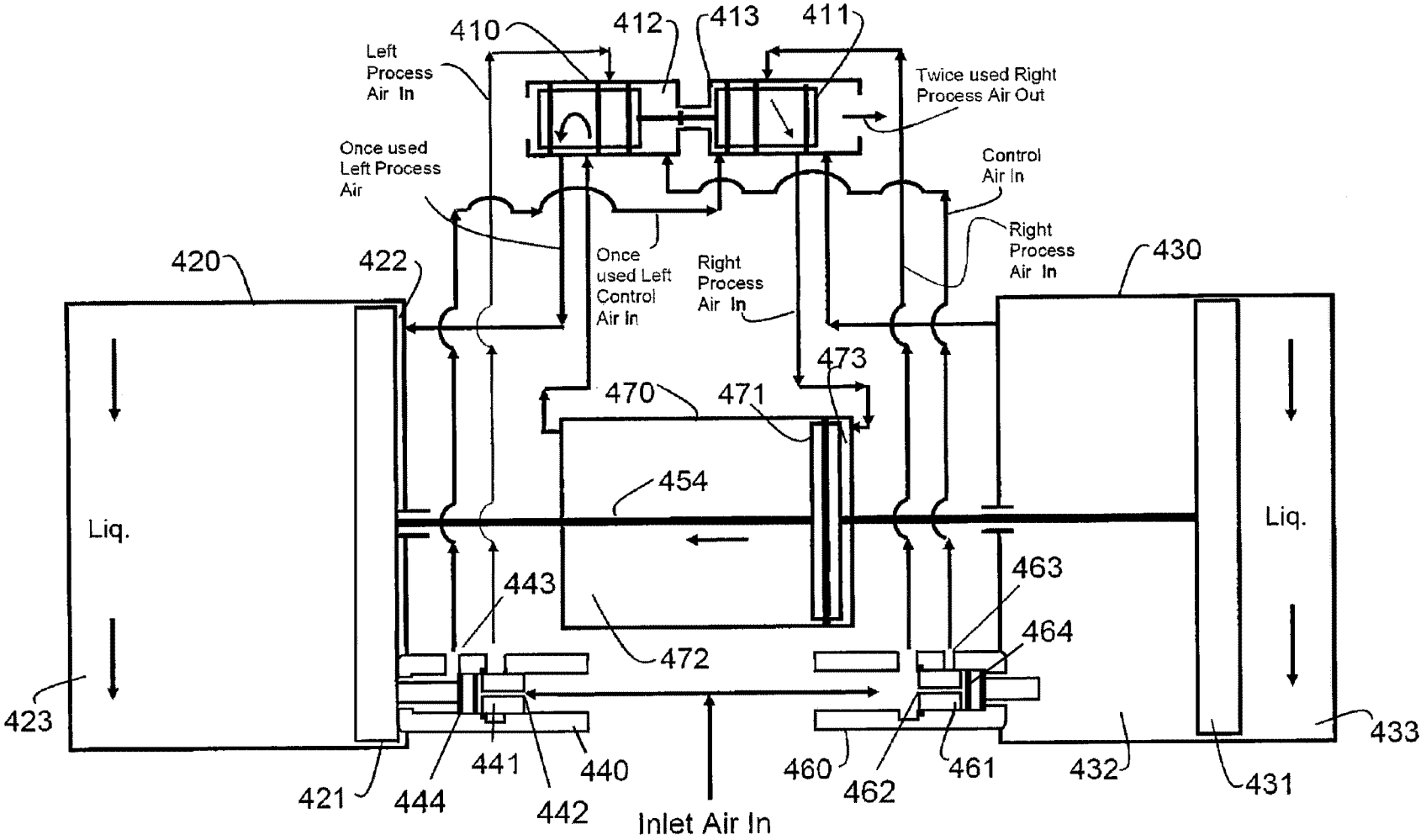

The air-driven pump system described in Example 2 is shown in FIGS. 7-9. Starting with FIG. 7, inlet motive air enters the pneumatic pump. A small portion of the motive air is used as control air and is channeled to directional valve 510, pressurizing chamber 512 acting on the small surface area of directional valve piston 511 inside directional valve 510. Also, control air is channeled out of chamber 512 and directional valve 510 and enters pilot valve 540, passes through pilot valve piston 541 and is channeled back to directional valve 510 where it pressurizes chamber 513 acting on the large surface area of directional valve piston 511, moving and holding directional valve piston 511 to the left inside directional valve 510. The balance of the inlet motive is segmented into left and right process air. Left process air enters efficiency valves 570, passes around efficiency valve piston 571 and exits efficiency valve 570 unrestricted in its flow. Right process air enters efficiency valves 580, passes around efficiency valve piston 581 and exits efficiency valve 580 maximally restricted in its flow. Both unrestricted left process air and maximally restricted right process air are channeled to directional valve 510. Directional valve piston 511 inside directional valve 510 blocks maximally restricted right process air and passes through unrestricted left process air. Unrestricted left process air exits directional valve 510 and is channeled to pump unit 530 where it expands and pressurize air chamber 532 causing piston 531 to displace liquid from liquid chamber 533. At the same time, shaft 554 being connected to pistons 531 and 521 moves piston 521 inside pump unit 520, drawing liquid into liquid chamber 523 as once used process air is released from air chamber 522 out of pump unit 520 and channeled through directional valve 510 and directional valve piston 511 to atmosphere.

In FIG. 8, toward the end of its stroke, piston 521 in pump unit 520 engages and moves efficiency valve piston 571 in efficiency valve 570. Efficiency valve piston 571 moves to a position that maximally restricts left process air flow rate out of efficiency valve 570. The maximally restricted left process air continues to be channeled to directional valve 510. Right process air moves efficiency valve piston 581 inside efficiency valve 580, allowing right process air to exit efficiency valve 580 unrestricted and continues to be channeled to directional valve 510. Piston 521 in pump unit 520 also engages and move shaft 564 which is connected to pilot valve piston 541 inside of pilot valve 540.

In FIG. 9, the pilot valve system with pilot valve piston 541 in pilot valve 540 is moved to a position that allows channeled control air to be released to atmosphere from chamber 513 inside of directional valve 510. Control air pressure in chamber 512, moves directional valve piston 511 to the "right" inside of directional valve 510. During the movement of directional valve piston 511, maximally restricted left process air continues to flow at its maximally restricted flow rate channeled into air chamber 532 of pump unit 530, reducing over filling or over pressurizing of air chamber 532. Directional valve piston 511 is held stationary to the right inside directional valve 510 by the control air pressure in chamber 512 of directional valve 510. Maximally restricted left process air exiting efficiency valve 570 is channeled to directional valve 510 and blocked by directional valve piston 511. Unrestricted right process air exiting efficiency valve 580 is channeled through directional valve 510 and directional valve piston 511 to pump unit 520, expanding into air chamber 522 as once used process air is channeled to atmosphere from air chamber 532 out of pump unit 530 and through directional valve 510 and directional valve piston 511. Pistons 521, 531 and shaft 554 reverse their directions. Unrestricted right process air acts on piston 521 in pump unit 520 to discharge liquid from liquid chamber 523 as piston 531 in pump unit 530 draws liquid into liquid chamber 533.

While this example refers to an embodiment with two efficiency units, one for left process air and the other for right process air, an alternative single efficiency unit embodiment could process both left and right process air inclusive. Such an embodiment would, therefore, combine certain elements of, for example, FIGS. 4 and 7.

Example 3

The air-driven pump system described in Example 3 is shown in FIGS. 10-13. Starting with FIG. 10, inlet motive air enters the pneumatic pump. The inlet motive air enters both efficiency valves 440, 460 and is segmented into control air, left process air and right process air by efficiency valve piston 441, 461 respectively. Inlet motive air passes through restrictive orifice 462 inside efficiency valve piston 461 and control air exits efficiency valve 460 through port 463 and is channeled to directional valve 410 where it enters and pressurizes chamber 412 acting on the directional valve piston 411. Simultaneously, lower pressure once used left control air from second stage air chamber 422 in pump unit 420 enters efficiency valve 440 and passes around efficiency valve piston 441 exiting efficiency valve 440 through port 443 and is channeled to directional valve 410 where it enters and pressurizes chamber 413 acting on directional valve piston 411, allowing directional valve piston to move and be held to the left in directional valve 410. Left process air passes around efficiency valve piston 441, maximally restricted in its flow rate. Right process air passes through efficiency valve 460, unrestricted in its flow rate by efficiency valve piston 461. Both left and right process air are channeled to directional valve 410 from their respective efficiency valves 440, 460. Directional valve piston 411 positioned to the left in directional valve 410, blocks maximally restricted left process air and allows unrestricted right process air to pass through and exit directional valve 410. Unrestricted right process air is then channeled to first stage pump unit 470 where it expands and pressurize first stage air chamber 473 acting on piston 471. Pistons 471, 421 and 431 are conjoined by shaft 454. Once used fixed volume left process air in first stage air chamber 472 of first stage pump unit 470 exits first stage pump unit 470 and is channeled through directional valve 410 and directional valve piston 411 to pump unit 420 where it expands into and pressurizes larger volume second stage air chamber 422 to a lower pressure acting on piston 421. Both second stage air chamber 422 and first stage air chamber 472 are at equal lower pressures. Simultaneously, twice used right process air is released from second stage air chamber 432 out of pump unit 430 and channeled through directional valve 410 to atmosphere. The combined air pressure forces acting on pistons 471, 421 and 431, all conjoined by shaft 454, moves piston 471, 421 and 431 in a direction that displaces liquid from liquid chamber 423 in pump unit 420 and draws liquid into liquid chamber 433 in pump unit 430.

Figure 11:
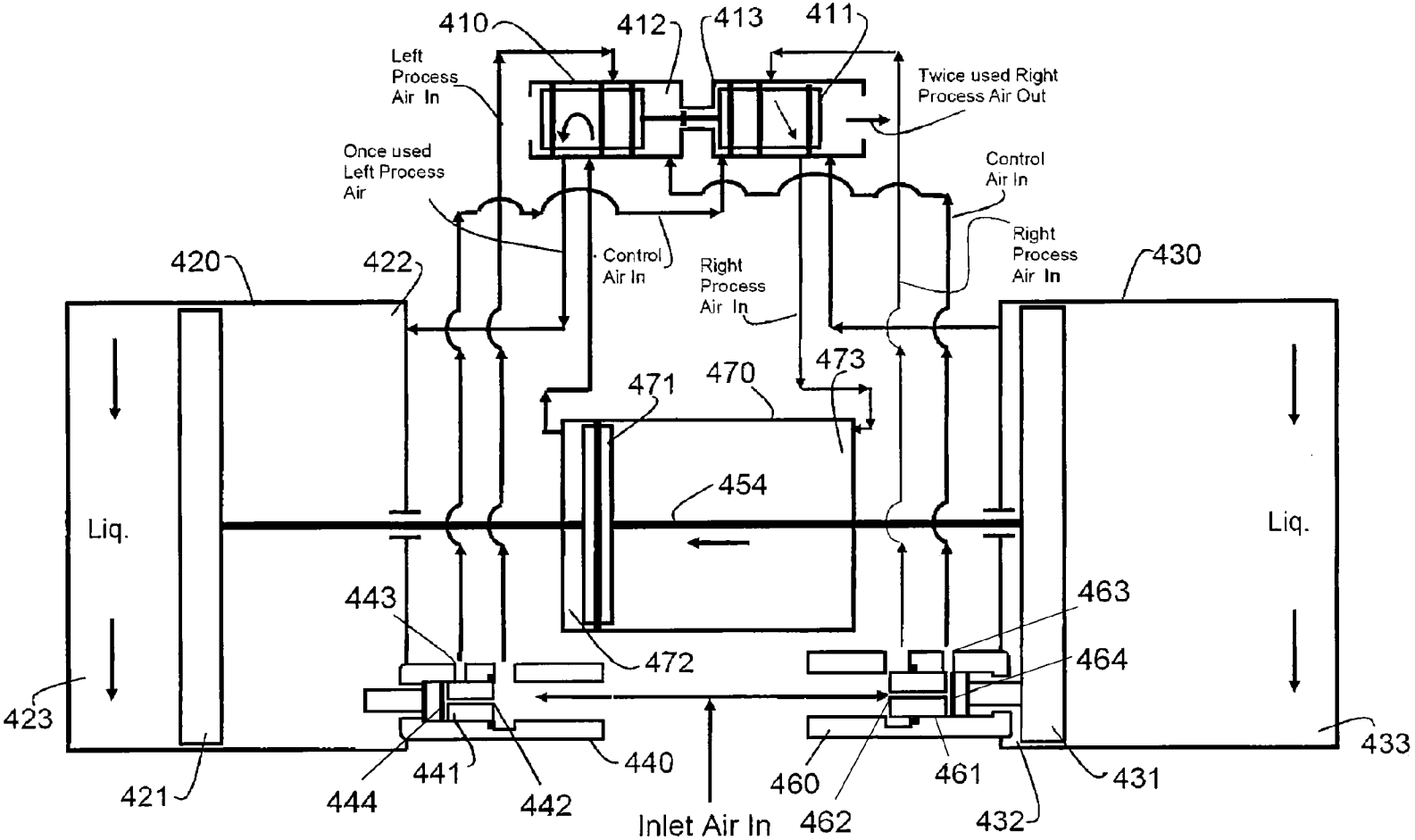

In FIG. 11, inlet motive air moves efficiency valve piston 441 in efficiency valve 440 allowing left process air to exit efficiency valve 440 unrestricted in its flow as it is channeled to directional valve 410 where it continues to be blocked by directional valve piston 411 in directional valve 410. Inlet motive air passes through restrictive orifice 442 inside efficiency valve piston 441 and control air exits efficiency valve 440 through port 443 and is channeled to directional valve 410 where it continues to pressurize chamber 413 inside directional valve 410. Inlet motive air passes through restrictive orifice 462 inside efficiency valve piston 461 and control air exits efficiency valve 460 through port 463 and is channeled to directional valve 410 where it continues to pressurize chamber 412 inside directional valve 410. Both chambers 412, 413 in directional valve 410 are at equal pressures acting on directional valve piston 411 continuing to hold directional valve piston 411 to the left inside of directional valve 410. Towards the end of its stroke, piston 431 in pump unit 430 engages and moves efficiency valve piston 461 inside efficiency valve 460. Efficiency valve piston 461 in efficiency valve 460 is moved to a position that maximally restricts right process air flow rate out of efficiency valve 460 as it is channeled to directional valve 410.

Figure 12:
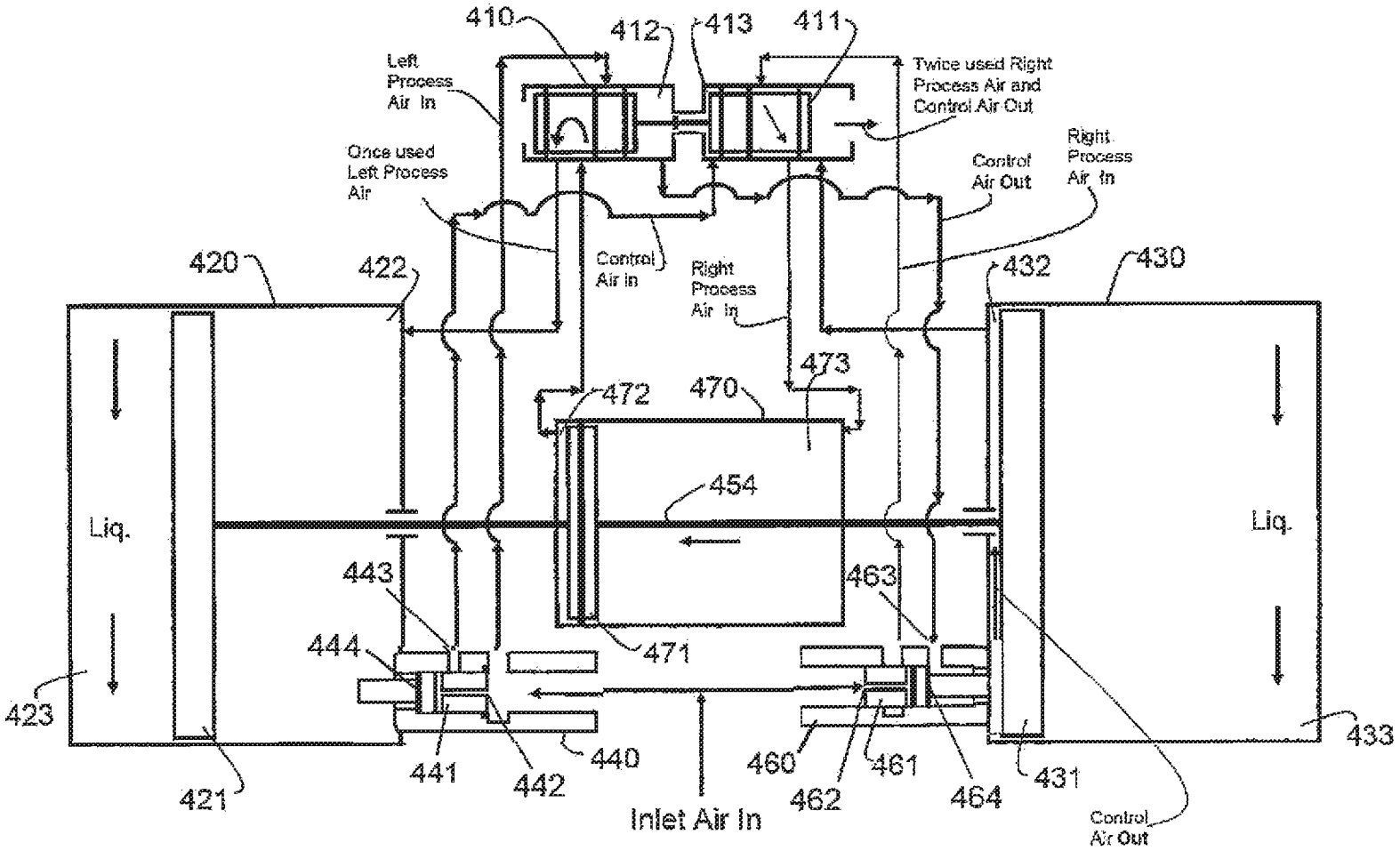

In FIG. 12, efficiency valve piston 461 in efficiency valve 460 is moved with annular seal 464 traversing port 463 to a position that redirects and releases channeled control air from chamber 412 in directional valve 410 through second stage air chamber 432 in pump unit 430 coupling with residual twice used right process air and then channeled through directional valve 410 to atmosphere.

Figure 13:
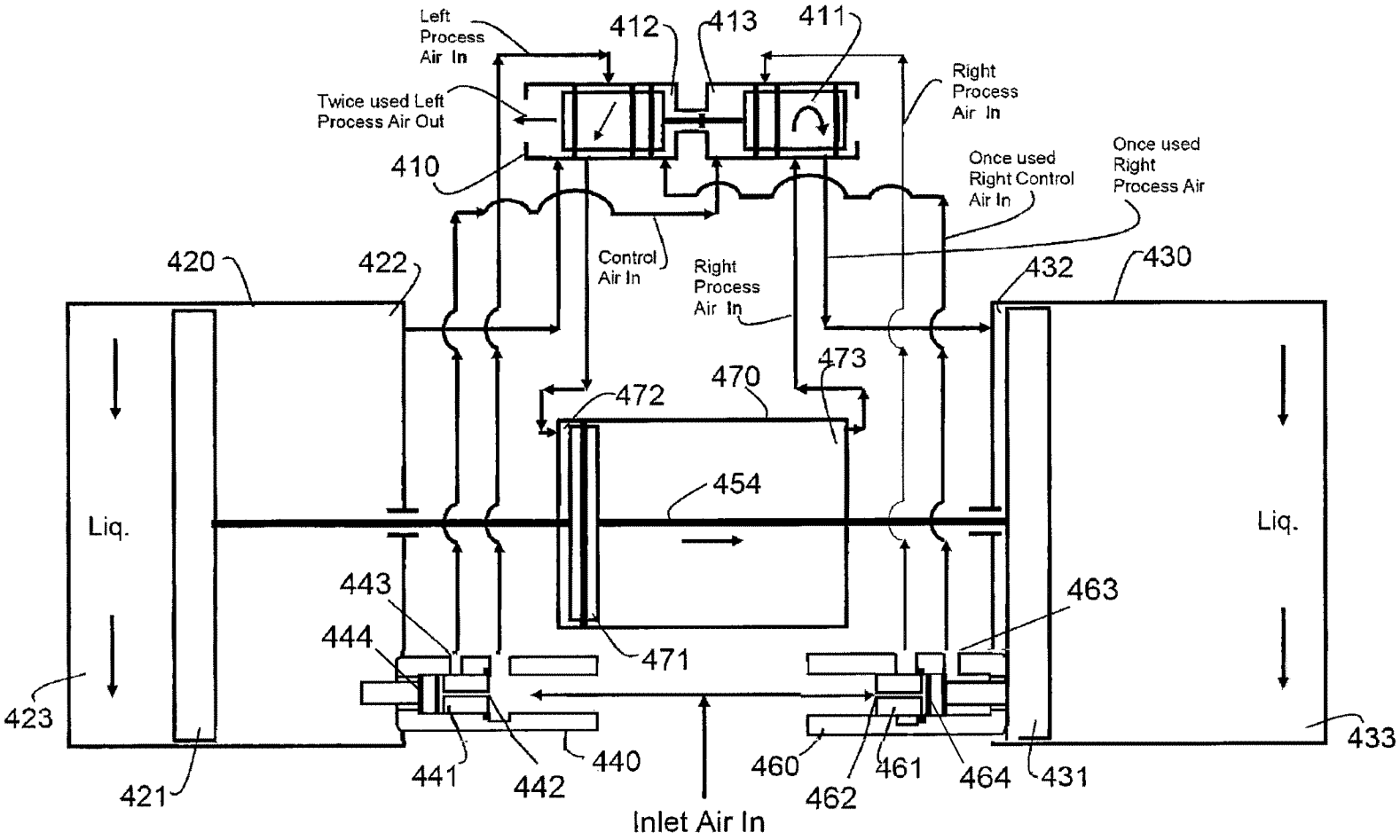

In FIG. 13, the combined control air pressure forces in chambers 412 and 413 of directional valve 410 have acted on and moved directional valve piston 411 to the right inside of directional vale 410 from the valve position of FIG. 12. During the movement of directional valve piston 411, maximally restricted right process air continues to flow at its maximally restricted flow rate channeled into first stage air chamber 473 of first stage pump unit 470, reducing over filling or over pressurizing of first stage air chamber 473. Directional valve piston 411 is held stationary by the control air pressure in chambers 412 and 413 inside directional valve 410. Maximally restricted right process air exiting efficiency valve 460 and channeled to directional valve 410 is blocked by directional valve piston 411. Unrestricted left process air exiting efficiency valve 440 and channeled to directional valve 410, passes through directional valve piston 411 and directional valve 410 channeled to first stage pump unit 470 where it expands and pressurize first stage air chamber 472 acting on piston 471 in first stage pump unit 470. Pistons 471, 421 and 431 are conjoined by shaft 454. Once used fixed volume left process air in first stage air chamber 473 of first stage pump unit 470 exits first stage pump unit 470 and is channeled through directional valve 410 and directional valve piston 411 to pump unit 430 where it expands into and pressurizes larger volume second stage air chamber 432 to a lower pressure acting on piston 431. Both second stage air chamber 432 and first stage air chamber 473 are at equal lower pressures. Simultaneously, twice used right process air is released from second stage air chamber 422 out of pump unit 420 and channeled through directional valve 410 to atmosphere. The combined air pressure forces acting on pistons 471, 421 and 431, all conjoined by shaft 454, moves piston 471, 421 and 431 in a direction that displaces liquid from liquid chamber 433 in pump unit 430 and draws liquid into liquid chamber 423 in pump unit 420. Simultaneously, lower pressure once used right control air from second stage air chamber 432 in pump unit 430 enters efficiency valve 460 and passes around efficiency valve piston 461 exiting efficiency valve 460 through port 463 and is channeled to directional valve 410 where it enters and pressurizes chamber 412 acting on directional valve piston 411, allowing directional valve piston 411 to remain held to the right in directional valve 410.

DEFINITIONS

The following definitions are provided for claim construction purposes:

pThe word "restrict" does not mean to shut off completely. Accordingly, if a flow is "restricted," the flow is not completely shut off.

Present invention: means "at least some embodiments of the present invention," and the use of the term "present invention" in connection with some feature described herein shall not mean that all claimed embodiments include the referenced features.

Embodiment: a machine, manufacture, system, method, process and/or composition that may (not must) be within the scope of a present or future patent claim of this patent document; often, an "embodiment" will be within the scope of at least some of the originally filed claims and will also end up being within the scope of at least some of the claims as issued (after the claims have been developed through the process of patent prosecution), but this is not necessarily always the case; for example, an "embodiment" might be covered by neither the originally filed claims, nor the claims as issued, despite the description of the "embodiment" as an "embodiment."

Although the present invention has been described in connection with a preferred embodiment, it should be understood that modifications, alterations, and additions can be made to the invention without departing from the scope of the invention as defined by the claims.

What is claimed is:

1. An air-driven pump comprising:

a source of pressurized air;

a first pump unit including a first pump chamber, a first air chamber and a first end of stroke position;

a second pump unit including a second pump chamber, a second air chamber and a second end of stroke position, an efficiency valve system pneumatically between the source of pressurized air and the first and second air chambers;

a directional control valve pneumatically between the efficiency valve system and the first and second air chambers;

a first air passage extending between the efficiency valve system and the directional control valve;

a second air passage extending between the efficiency valve system and the directional control valve, the directional control valve shifting at the end of stroke positions to control air communication from the first and second air passages to the first and second air chambers, respectively, the efficiency valve system including a first valve position defining unrestricted air communication between the source of pressurized air and the first air passage and restricted air communication between the source of pressurized air and the second air passage and a second valve position defining unrestricted air communication between the source of pressurized air and the second air passage and restricted air communication between the source of pressurized air and the first air passage, the efficiency valve system shifting between the first and second valve positions before the directional control valve has shifted.

2. The air-driven pump of claim 1, the source of pressurized air being in continuous air communication with the directional control valve across the efficiency valve system through the first passage and in continuous air communication with the directional control valve across the efficiency valve system through the second air passage.

3. The air-driven pump of claim 1, the efficiency valve system further including efficiency valve system shifting elements extending into the first and second air chambers.

4. The air-driven pump of claim 1 further comprising:

a pilot valve system pneumatically shifting the directional control valve at the first and second end of stroke positions, respectively.

5. The air-driven pump of claim 4, the pilot valve system including a pilot passage, the pilot passage being in continuous air communication with the directional control valve and the pilot passage being alternately in air communication with the source of pressurized air and atmosphere.

6. The air-driven pump of claim 4 further comprising:

a valve cylinder including pilot valve ports therethrough, first efficiency valve ports therethrough and second efficiency valve ports therethrough;

a valve piston including a pilot valve groove thereacross selectively in communication with the pilot valve ports, a first efficiency valve groove thereacross selectively in communication with the first efficiency valve ports, a second efficiency valve groove thereacross selectively in communication with the second efficiency valve ports, a first efficiency valve piston land selectively in communication with the first efficiency valve ports and a second efficiency valve piston land selectively in communication with the second efficiency valve ports, the pilot valve system including the pilot valve ports and the pilot valve groove, the efficiency valve system including the first and second efficiency valve grooves and the first and second efficiency valve lands.

7. An air-driven pump comprising:

a source of pressurized air;

a first pump unit including a first pump chamber, a first air chamber, a first divider between the first pump chamber and the first air chamber and a first end of stroke position of the first divider;

a second pump unit including a second pump chamber, a second air chamber, a second divider between the second pump chamber and the second air chamber and a second end of stroke position of the second divider;

an efficiency valve system pneumatically between the source of pressurized air and the first and second air chambers;

a directional control valve pneumatically between the efficiency valve system and the first and second air chambers;

a first air passage extending between the efficiency valve system and the directional control valve;

a second air passage extending between the efficiency valve system and the directional control valve, the directional control valve shifting at the end of stroke positions to control air communication from the first and second air passages to the first and second air chambers, respectively, the efficiency valve system including a first valve position defining unrestricted air communication between the source of pressurized air and the first air passage and restricted air communication between the source of pressurized air and the second air passage and a second valve position defining unrestricted air communication between the source of pressurized air and the second air passage and restricted air communication between the source of pressurized air and the first air passage, the efficiency valve system shifting between the first and second valve positions before the directional control valve has shifted.

8. The air-driven pump of claim 7, the efficiency valve system further including efficiency valve system shifting elements extending into the first and second air chambers.

9. The air-driven pump of claim 7, the source of pressurized air being in continuous air communication with the directional control valve across the efficiency valve system through the first passage and in continuous air communication with the directional control valve across the efficiency valve system through the second air passage.

10. The air-driven pump of claim 7 further comprising:

a pilot valve system pneumatically shifting the directional control valve at the first and second end of stroke positions, respectively.

11. The air-driven pump of claim 10, the pilot valve system including a pilot passage, the pilot passage being in continuous air communication with the directional control valve and the pilot passage being alternately in air communication with the source of pressurized air and atmosphere.

12. The air-driven pump of claim 10 further comprising:

a valve cylinder including pilot valve ports therethrough, first efficiency valve ports therethrough and second efficiency valve ports therethrough;

a valve piston including a pilot valve groove thereacross selectively in communication with the pilot valve ports, a first efficiency valve groove thereacross selectively in communication with the first efficiency valve ports, a second efficiency valve groove thereacross selectively in communication with the second efficiency valve ports, a first efficiency valve piston land selectively in communication with the first efficiency valve ports and a second efficiency valve piston land selectively in communication with the second efficiency valve ports, the pilot valve system including the pilot valve ports and the pilot valve groove, the efficiency valve system including the first and second efficiency valve grooves and the first and second efficiency valve lands.

13. An air-driven pump comprising:

a source of pressurized air;

a first pump unit including a first pump chamber and a first air chamber;

a second pump unit including a second pump chamber and a second air chamber, an efficiency valve system including a first air passage pneumatically between the source of pressurized air and the first air chamber and a second air passage pneumatically between the source of pressurized air and the second air chamber;

a directional control valve pneumatically between the first air passage and the first air chamber and pneumatically between the second air passage and the second air chamber, the directional control valve selectively controlling air communication from the first and second air passages to the first and second air chambers, respectively, the efficiency valve system selectively restricting air communication between the source of pressurized air and the first and second air passages, unrestricted air communication and restricted air communication between the source of pressurized air and the directional control valve being concurrently in communication through the first and second air passages.

14. The air-driven pump of claim 13, the source of pressurized air being in continuous air communication with the directional control valve through the first air passage and in continuous air communication with the directional control valve through the second air passage.

15. The air-driven pump of claim 13, the efficiency valve system including two efficiency valves, each efficiency valve having an efficiency valve in an efficiency valve cylinder and a shaft extending into one of the air chambers to selectively engage the pump.

16. The air-driven pump of claim 15, each efficiency valve having an unrestricted air communication position and a restricted air communication position.

17. The air-driven pump of claim 15, the pilot valve system including pilot passages through each of the efficiency valves.

18. The air-driven pump of claim 13 further comprising:

a pilot valve system shifting the directional control valve at end of stroke positions of the pump to selectively control the directional control valve.

19. The air-driven pump of claim 18 further comprising:

a valve cylinder including pilot valve ports therethrough, first efficiency valve ports therethrough and second efficiency valve ports therethrough;

a valve piston including a pilot valve groove thereacross selectively in communication with the pilot valve ports, a first efficiency valve groove thereacross selectively in communication with the first efficiency valve ports, a second efficiency valve groove thereacross selectively in communication with the second efficiency valve ports, a first efficiency valve piston land selectively in communication with the first efficiency valve ports and a second efficiency valve piston land selectively in communication with the second efficiency valve ports, the pilot valve system including the pilot valve ports and the pilot valve groove, the efficiency valve system including the first and second efficiency valve grooves and the first and second efficiency valve lands.

* * * * *